United States Patent [19]

Hayashi et al.

[11] Patent Number: 4,510,787

[45] Date of Patent: Apr. 16, 1985

[54] METHOD OF MANUFACTURING HOLLOW RODS

[75] Inventors: Chihiro Hayashi; Kazuyuki Nakasuji, both of Amagasaki, Japan

[73] Assignee: Sumitomo Metal Industries, Ltd., Osaka, Japan

[21] Appl. No.: 508,718

[22] Filed: Jun. 28, 1983

[30] Foreign Application Priority Data

Jun. 30, 1982 [JP] Japan ..... 57-114363
Apr. 22, 1983 [JP] Japan ..... 58-71739

[51] Int. Cl.[3] ..... B21B 27/02; B21B 19/04

[52] U.S. Cl. ..... 72/368; 72/68; 72/100; 29/527.7

[58] Field of Search ..... 72/68, 78, 95, 96, 97, 72/100, 368; 29/527.7

[56] References Cited

U.S. PATENT DOCUMENTS 374,703 12/1887 Ritchie ..... 72/100 X
1,957,916 5/1934 Stiefel ..... 72/97
2,063,689 12/1936 Littler ..... 72/68
3,495,429 2/1970 Muller ..... 72/100
4,202,194 5/1980 Hartog et al. ..... 72/78
4,416,134 11/1983 Hayashi ..... 72/68

FOREIGN PATENT DOCUMENTS 114407 9/1980 Japan .

*Primary Examiner*—W. D. Bray
*Attorney, Agent, or Firm*—Burns, Doane, Swecker & Mathis

[57] ABSTRACT

A method of manufacturing hollow rods of very thick wall, in which wall thickness to outside diameter ratio is 25% or more, such as those used as work stock for manufacturing oil-well drilling collars. A cross-type or rotary mill having three or four cone-type rolls is employed without using internal sizing tools such as plug or the like, whereby a hollow work piece is worked and reduced in both outside diameter and wall thickness to the target values. In order to obtain higher dimensional accuracy and to prevent deterioration of the work material in mechanical properties, the cross angle should be positive and the feed angle should be set within the range of $3° \leqq \beta \leqq 20°$.

12 Claims, 13 Drawing Figures

(a)

(b)

METHOD OF MANUFACTURING HOLLOW RODS

BACKGROUND OF THE INVENTION (1) Field of the Invention

The present invention relates to a method of manufacturing hollow rods. The term "hollow rods" herein generally refers to extra-thick-walled hollow rods of the type which are produced at steel rod rolling mills at large, and more particularly to such rods having a wall thickness to diameter ratio (hereinafter referred to as T/D) of 25% or above which cannot be manufactured into seamless tubes at any existing mandrel mill plant, typical of such rods being those for manufacture of oil-well drill collars.

(2) Description of the Prior Art

The manufacture of hollow rods of the type is conventionally carried out in manner as illustrated in FIG. 1, a schematic view showing a conventional process of manufacturing hollow rods. That is, a billet $B_1$ is passed through a rolling mill 31 into a square billet $B_2$ having specified dimensions (FIG. 1(*a*)); the square billet $B_2$ is centrally pierced into a square hollow billet $B_3$ by using a drill 32 (FIG. 1(*b*)); then a mandrel 33 of manganese steel is inserted into the hollow billet $B_3$ (FIG. 1 (*c*)); the hollow billet $B_3$ having the mandrel 33 so inserted is heated to the specified temperature in a heating furnace 34 (FIG. 1(*d*)); thereafter, it is passed through a bar mill 35 consisting of more than ten roll stands, each having caliber rolls 35*a*, so that the hollow billet $B_3$ is finished to the desired diameter and wall thickness (FIG. 1(*e*)); the mandrel 33 is removed from the hollow billet $B_3$ and the latter is cut to the specified length (FIG. 1(*f*)); and subsequently, the hollow billet $B_3$ is subjected to bend straightening by a straightening machine 36 into a hollow rod $B_4$ as a product (FIG. 1(*g*)).

The conventional manufacturing process as above described involves the following problems: (1) the hollow billet $B_3$ is rolled, with the mandrel 33, an internal sizing tool, inserted therein, and since the mandrel 33 is subject to plastic deformation, the product is unsatisfactory in roundness and liable to wall eccentricity; (2) the product is considerably inconsistent in inner diameter, which means inconsistency of the wall thickness, and accordingly its dimensional accuracy is low as a whole; and (3) the mandrel 33, which is subject to plastic deformation, is to be discarded after use, and accordingly the unit tool requirement is costly and uneconomical. With a view to overcoming one of these difficulties, or the disadvantage that the unit tool requirement is costly due to the use of a mandrel, it has been proposed to produce hollow rods in the following manner. That is, a bloom is pierced into a hollow piece by employing a press piercing mill, and then the hollow piece is reduced by being passed through a continuous rolling machine having caliber rolls of oval round type arranged in an alternately horizontal-vertical pattern, without using any internal sizing tool (Japanese Patent Kokai No. 114,407 of Showa 55).

However, experiments by the present inventors have proved that with such method it is extremely difficult to obtain sufficient roundness, where two-high mill type roll stands having caliber rolls are employed. It has also been confirmed that where block mill of three-roll type having caliber rolls are employed, better roundness can be obtained than where two-mill type is employed, but that such method has still its limitation.

Beside said method there is known one similar to the method of the present invention, that is, U.S. Pat. No. 374,703 entitled "Rolls for reducing and tapering tubes and rods" (Dec. 13, 1887). However, these rolls are different from those according to the invention, in configuration and the relationship between cross angle and the position of each larger diameter side roll portion. And there is known one similar to the method of the present invention, this is U.S. Pat. No. 3,495,429 entitled "Method of reducing tubes, especially thick-walled tubes and means for practicing the method" (Feb. 17, 1970). However, this method is different from the present invention, in configuration of the rolls and the inside diameter of a hollow rod is not reduced according to the present invention.

There is known another similar method claimed by one of the present inventors and entitled "Process for manufacturing seamless metal tubes (Fil. No. 06/281,901). This prior method consists essentially in subjecting a shell being worked to outside-diameter reduction by means of a rotary mill having three or four rolls arranged around a pass line and without using internal sizing tools, the axes of the rolls being inclined or inclinable so that the shaft ends on either side of the rolls stay close to or stay away from the pass line, said axes being inclined so that the shaft ends on the respective sides of the rolls face in the peripheral direction on one and the same side of the shell being worked.

In other words, the principle of said method is based on the fact that where the shell has some wall eccentricity if its outside diameter is reduced so that the wall thickness is increased, the degree of thickness increase is greater in a thin wall portion than in a thick wall portion, wall thickness of the shell being equalized in the light of such fact. According to experiments by the present inventors, however, such wall equalization is achievable only where T/D is 25% or lower, and indeed it has been confirmed that where T/D is more than 25%, it is physically impossible to increase the wall thickness by outside-diameter reduction according to the prior method. This means that the method of said prior application is intended for use only where T/D is 25% or below. On the other hand, the method of the present invention is applicable in the case where T/D is 25% or above. Furthermore, whereas the prior method is one for diameter reduction in which wall thickness is increased, the present invention is intended to effect elongation so that the wall thickness, as well as the outside diameter, is reduced. As such, it is obvious that the two methods are entirely different in subject matter.

OBJECTS AND BRIEF SUMMARY OF THE INVENTION

The present invention has been made under the above described technical background.

Accordingly, it is an object of the invention to provide a method of manufacturing hollow rods which requires no internal sizing tool, thus being free from economic burden therefor, and which makes it possible to obtain hollow rods with high dimensional accuracy in wall thickness as well as in outside diameter.

It is another object of the invention to provide a method of manufacturing hollow rods which permits production of a product conforming to the specified dimensions, without deteriorating the mechanical properties of the material of the product.

The method of the invention for manufacturing hollow rods comprises:

a piercing step in which a round billet is pierced into a hollow piece by machining or plastic working, and an elongating step in which the hollow piece is reduced in both outside diameter and wall thickness to the desired dimensional values so that it is turned into a hollow rod having a wall thickness to diameter ratio of 25% or above, said elongating step being carried out by means of a rotary rolling mill having three or four cone-type rolls arranged around a pass line for the hollow piece being worked and without using any internal sizing tool, said rolls being such that their diameters may be varied straightly along the axes thereof, said rotary mill being of such cross-roll type that the axes of the rolls are inclined or inclinable by a cross angle $\gamma$ so that the shaft ends on either side of the rolls stay close to or stay away from the pass line, the axes of the rolls being inclined by a feed angle $\beta$ so that the shaft ends on the respective sides of the rolls face in the peripheral direction on one and same side of the hollow piece being worked.

The above and further objects and features of the invention will more fully be apparent from the following detailed description with accompanying drawings.

BRIEF DESCRIPTION OF THE DRAWINGS

FIG. 3(*b*) is a schematic sectional view taken on the line b—b in FIG. 3(*a*);

FIG. 3(*c*) is a schematic side view taken on the line c—c in FIG. 3(*b*);

FIG. 4(*b*) is a schematic sectional view taken on the line b—b in FIG. 4(*a*);

FIG. 4(*c*) is a schematic sectional view taken on the line c—c in FIG. 4(*b*);

FIG. 6(*b*) is a section showing a hollow rod produced according to the conventional method;

DETAILED DESCRIPTION OF THE INVENTION

Figure 1:
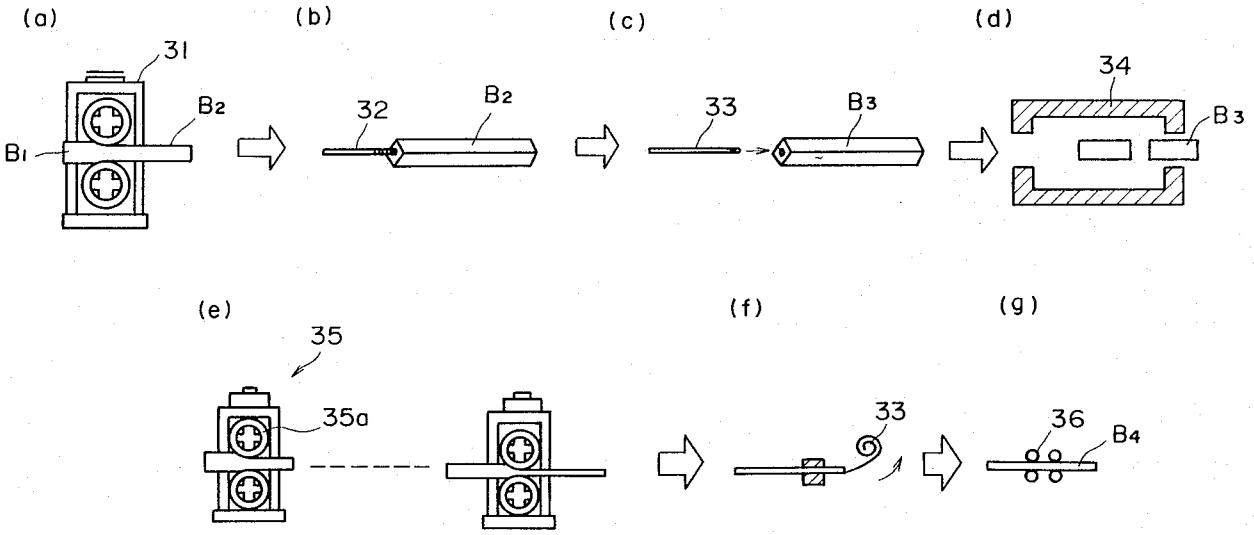
FIG. 1 is a schematic view showing a conventional method on a step by step basis.
Figure 2:
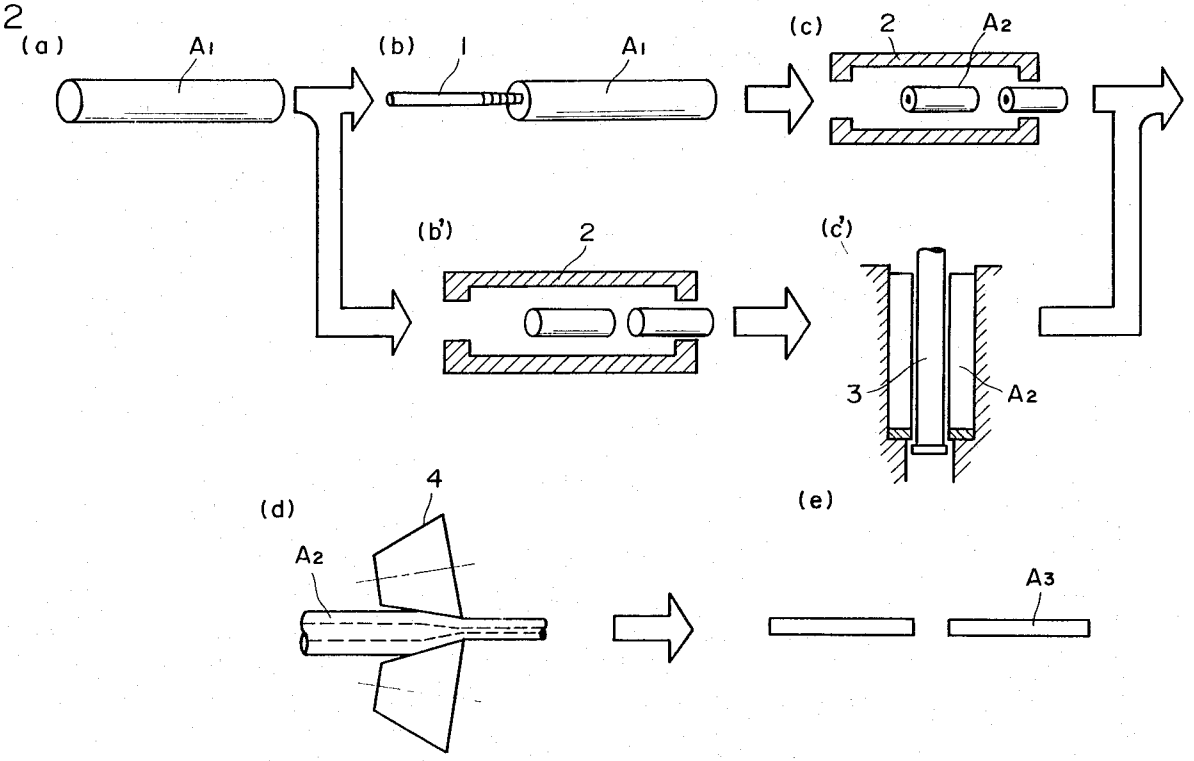
FIG. 2 is a schematic view showing the method of the present invention on a step by step basis.
Figure 3:
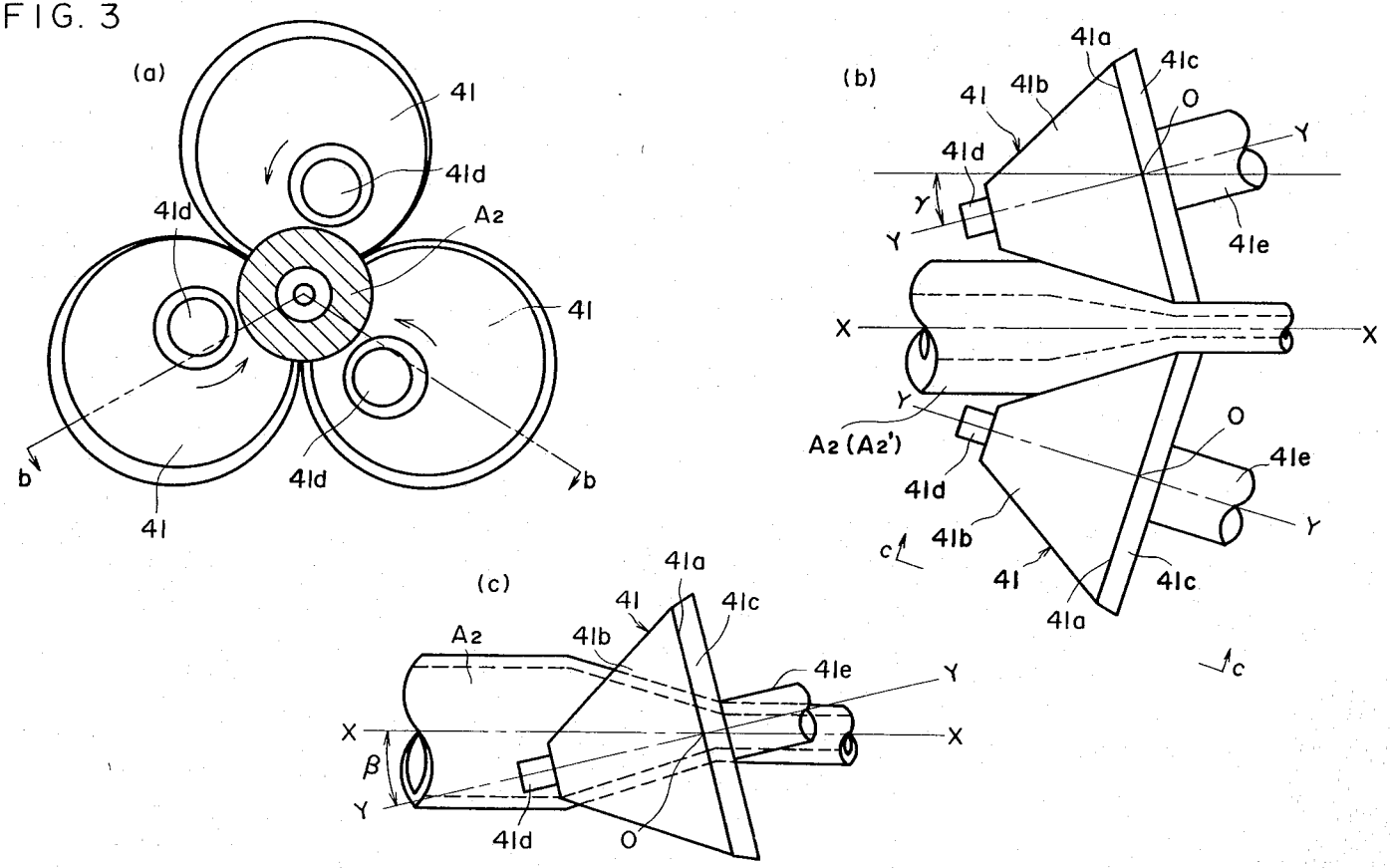
FIG. 3(*a*) is a schematic view in front elevation showing a rotary mill employed in working the method of the invention.

The method of the invention will now be described in detail with reference to the drawings showing the working thereof. FIG. 2 is a schematic representation showing various stages involved in the method of manufacturing hollow rods according to the invention (hereinafter referred to as the present method), in order of sequence. A round rod stock $A_1$ (which may be a round billet) of a specified diameter is prepared as shown in FIG. 2(*a*). The round stock $A_1$ is pierced into a hollow piece $A_2$ by mechanical working using a drill 1, as shown in FIG. 2(*b*). After heated to a specified temperature as shown in FIG. 2(*c*), the hollow piece $A_2$ is subjected to elongation by means of a rotary mill 4 as shown in FIG. 2(*d*). Alternatively, the round rod stock $A_1$ supplied is first heated in a heating furnace 2 to a specified temperature which is suitable for plastic working, as shown in FIG. 2(*b'*) and then the heated round stock $A_1$ is centrally pierced into a hollow piece $A_2$ by means of an extruder 3, as shown in FIG. 2(*c'*). The hollow piece $A_2$ is then subjected to elongation by means of the rotary mill 4, as shown in FIG. 2(*d*). The elongated hollow piece is cut into hollow rods $A_3$ of a specified length, as shown in FIG. 2(*e*). The rotary mill 4 is of such arrangement as shown in FIGS. 3(*a*), (*b*) and (*c*). FIG. 3(*a*) is a schematic view in front elevation showing a hollow piece $A_2$ being worked by the rotary mill 4 as seen from the hollow-piece inlet side. FIG. 3(*b*) is a section taken along the line b—b in FIG. 3(*a*), and FIG. 3(*c*) is a side view taken on the line c—c in FIG. 3(*b*). Rolls 41 each has a gorge 41*a* adjacent one axially oriented end thereof, the diameter of the roll being gradually reduced toward on shaft end thereof from the gorge 41*a* in a straight line pattern and gradually enlarged toward the other shaft end from the gorge in a straight line or curved line pattern, so that the roll has a substantially truncated cone shape with an inlet surface 41*b* and an outlet surface 41*c*. The rolls are so disposed that their respective inlet surfaces 41*b* are positioned on the upstream side of the rolls relative to the path of the hollow piece $A_2$. Further, the rolls 41 are arranged in substantially equally spaced apart relation around a pass line X—X of the hollow piece $A_2$, intersecting points O, each between the roll axial line Y—Y and a plane including the gorge 41*a* (said intersecting point to be hereinafter referred to as roll setting center), being positioned on a plane intersecting orthogonally with said pass line X—X, so that the axial line Y—Y of each roll, both end shaft portions 41*d*, 41*e* of which are supported by bearings not shown, intersects at the roll setting center O with the pass line X—X at a specified angle $\gamma$ (hereinafter referred to as cross angle) so that the front end of the roll, as seen in top plan elevation, that is, the front shaft end of the roll stays close to the pass line X—X. Also, as can be seen from FIG. 3(*a*) in which three rolls 41 are shown as to their mutual relationship and from FIG. 3(*c*) in which an angular relation is shown, the rolls 41 are arranged in such manner that they are inclined at a specified angle $\beta$ (hereinafter referred to as feed angle) so that their respective front shaft ends face one peripheral direction of the hollow piece $A_2$.

Figure 4:
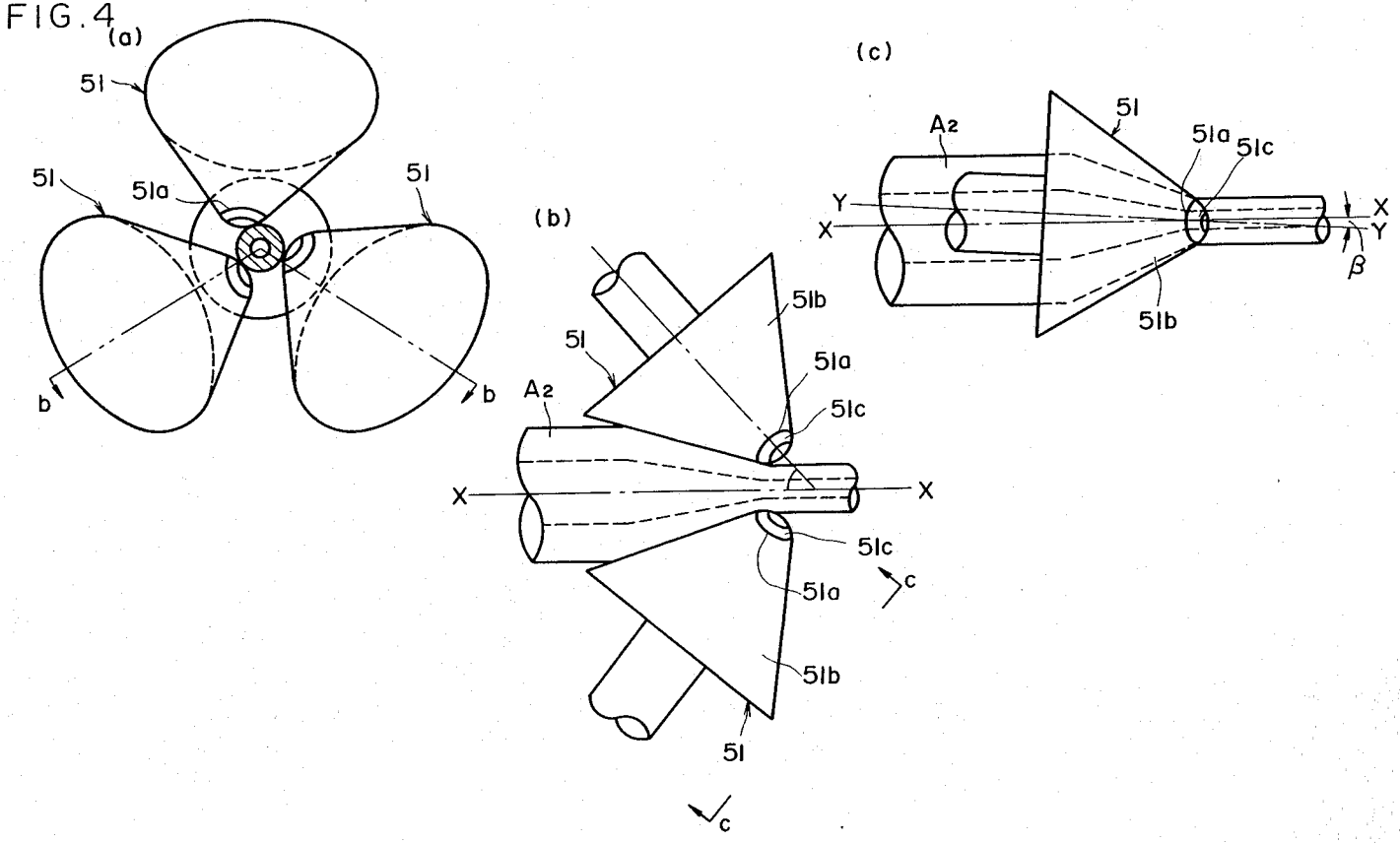
FIG. 4(*a*) is a schematic view in front elevation showing another rotary mill employed in working the method of the invention.

The rolls 41, connected to a drive source not shown, are rotated in the direction of the arrows shown in FIG. 3(*a*) so that a hollow piece $A_2$ threaded into the gap between the rolls 41 is moved along the pass line while being rotated on the axis thereof. That is, the hollow piece $A_2$ is elongated under heavy reduction while being screwed forward for both diameter reduction and wall thickness reduction. FIGS. 4(*a*), 4(*b*) and 4(*c*) show another arrangement for elongation stage and rotary mill employed in the present invention, FIG. 4(*a*) being a schematic view in front elevation of the rotary mill as seen from its outlet side, FIG. 4(*b*) a schematic sectional view taken on line b—b in FIG. 4(*a*), and FIG. 4(*c*) a schematic side view taken on line c—c in FIG. 4(*b*). In the figures, numeral 51 designates elongating rolls. The rolls 51 are substantially same as those shown in FIGS. 3(*a*), 3(*b*) and 3(*c*), but their arrangement relative to the direction of travel of hollow pieces $A_2$ is opposite from that in FIG. 3. That is, the rolls 51 each has a gorge 51*a* adjacent one axially oriented end thereof, the diameter of the roll being gradually reduced toward one shaft end thereof from the gorge 51*a* in a straight line or curved line pattern and gradually enlarged toward the other shaft end from the gorge 51*a* in a straight line pattern, so that the roll has a substantially truncated cone shape with an outlet surface 51*c* and inlet surface 51*b*. The rolls 51 are arranged in substantially equally spaced apart relation around the pass line X—X of hollow piece $A_2$, roll setting centers O being positioned on a plane intersecting orthogonally with the pass line X—X, with the inlet surface 51*b* of each roll 51 disposed on the upstream side of the roll relative to the path of hollow piece $A_2$. The axial line Y—Y of each roll 51 intersects at the roll setting center O with the pass line X—X so that the rear end thereof stays away at cross angle $\gamma$ from the pass line X—X as can be seen in plan view in FIG. 4(*b*) and the front shaft end is inclined at feed angle $\beta$ toward the pass line X—X and on same side of the hollow piece $A_2$ being worked as can be seen from FIG. 4(*c*).

As is apparent from a comparison between FIG. 3(*b*) and FIG. 4(*b*), the cross angle $\gamma$ with respect to the rolls 51 of the rotary mill shown in FIGS. 4(*a*), 4(*b*) and 4(*c*) is inverse to that in FIG. 3. The cross angle $\gamma$ shown in FIG. 3 is defined as positive ($\gamma > O$), and that in FIG. 4 as negative ($\gamma < O$).

The above described cross angle and feed angle have close relations with the inside diameter of hollow rod as a product. Therefore, it is desirable to predetermine the relationship between cross and feed angles and inside diameter so that cross and feed angles may be suitably set and controlled according to the target value. There is no particular limitation on how to preset cross and feed angles. Any conventional angle setting method may be employed as it is or with some suitable modification which will permit a wider setting range. The relationship between cross and feed angles and hole diameter is illustrated in FIGS. 5(*a*), 5(*b*) and 5(*c*) by way of example.

Figure 5:
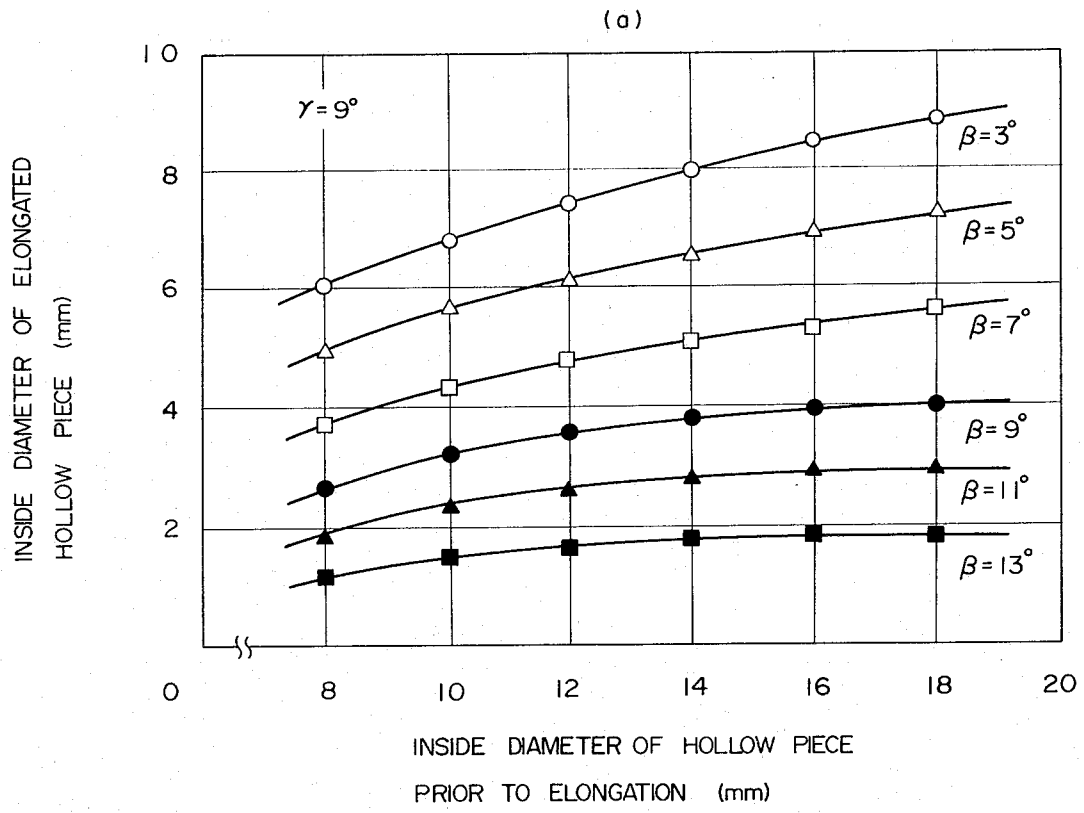
FIG. 5 is a graphical representation showing the relationship between cross and feed angles and hole diameters of hollow rods.
Figure 5:
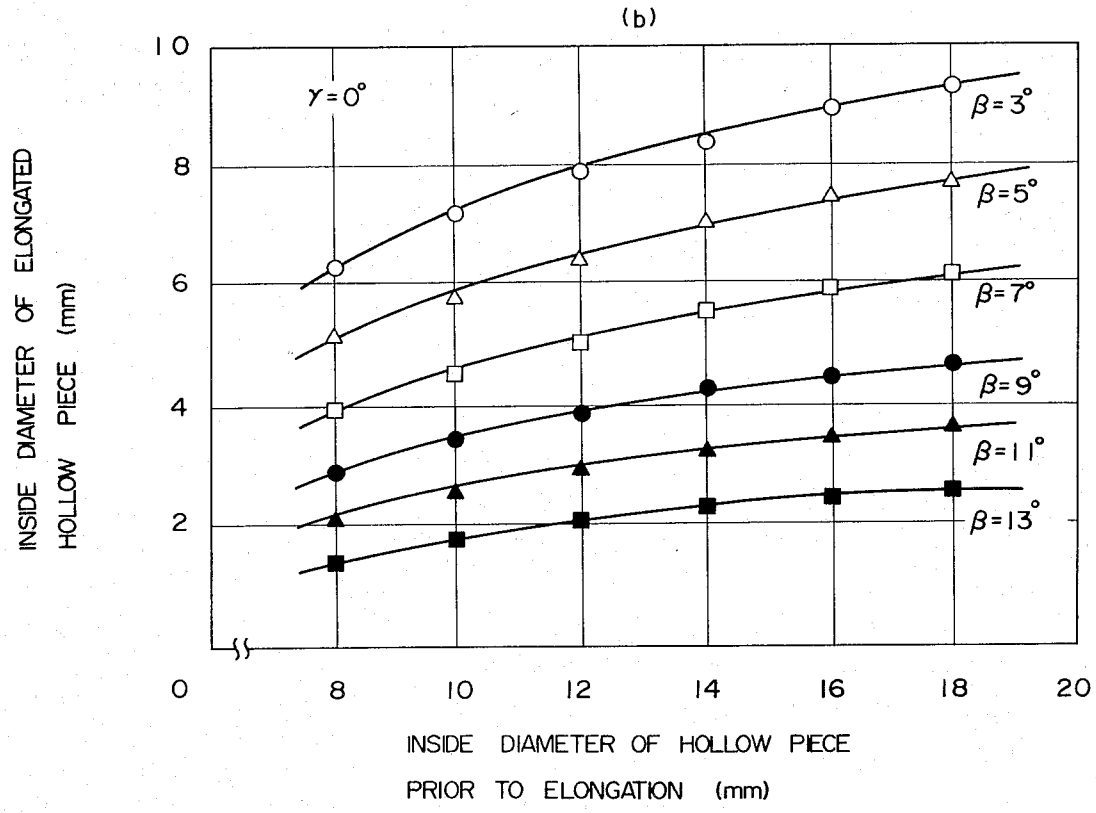
Figure 5:
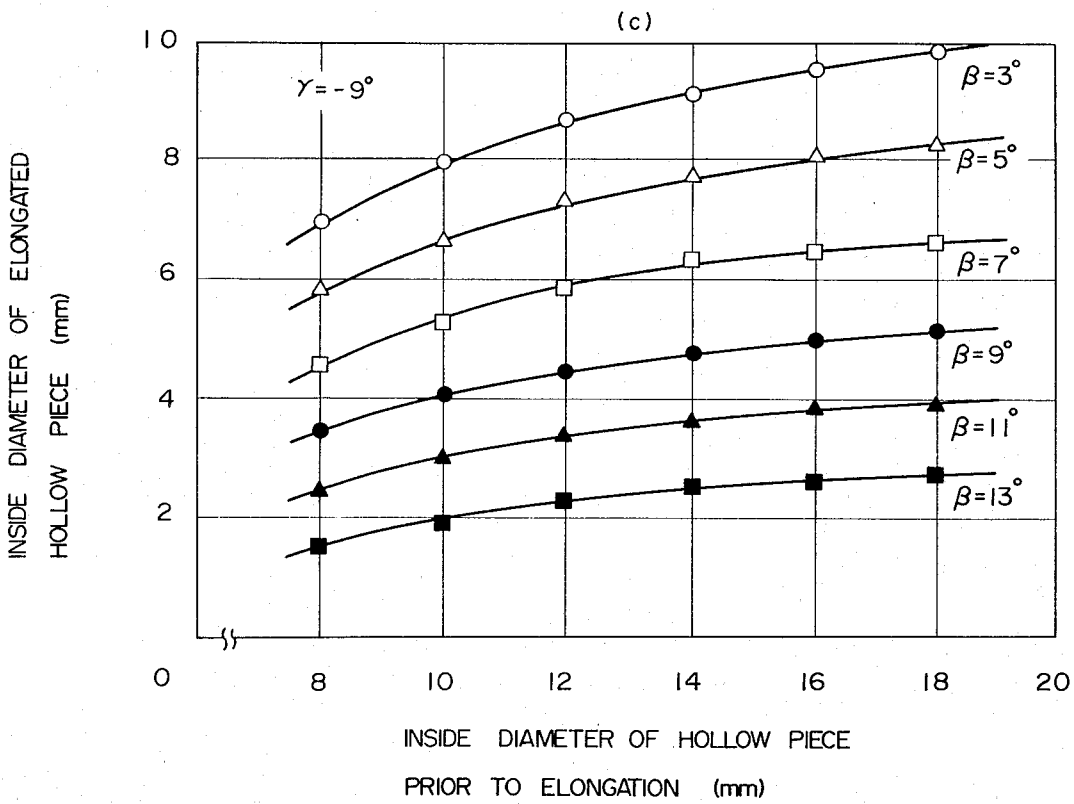

In FIGS. 5(*a*), 5(*b*) and 5(*c*), the inside diameter (mm) of hollow piece prior to elongation is shown on the abscissa and inside diameter (mm) of elongated hollow piece is shown on the ordinate. Cross angle $\gamma$ is set at 9° in FIG. 5(*a*), at 0° in FIG. 5(*b*), and at −9° in FIG. 5(*c*). Whilst, for feed angle $\beta$ there are shown six variations, namely, 3°, 5°, 7°, 9°, 11°, and 13°. In all cases shown, the rotary mill is a cone-type 3-roll mill. Each roll is made of Chromium Molybdenum steel with a gorge diameter of 205 mm. Round billets of SAE1045 were used as test pieces, each being 70 mm in diameter and 300 mm in length. They were centrally pierced by machining into hollow pieces having 8 mm, 10 mm, 12 mm, 14 mm, 16 mm, and 18 mm dia. holes. The hollow pieces were elongated at 1200° C. by a 3-roll cross-type rotary mill having regulated cross and feed angle arrangement and without using internal sizing tools such as mandrel or the like. The outside diameter was reduced from 70 mm to 33 mm. For each test piece, the hole diameters prior to and after elongation were examined.

As can be clearly seen from the graphs, when the elongated pieces are compared with the hollow pieces prior to elongation, both outside diameter and wall thickness have been reduced. Apparently, at any of the cross angles $\gamma$, 9°, 0° and −9°, the hole diameter has been reduced, the effect of diameter reduction being greatest where $\gamma = 9°$. Further, it is noted that where the feed angle was varied while the cross angle was constant, there occurred changes in the hole diameter. This fact tells that it is possible to control hole diameter by suitably setting and regulating cross and feed angles.

Next, the results of comparative tests on the present method and conventional method will be presented.

For the purpose of testing the present method, pieces of round steel bar, SAE1045, were used as test pieces. These pieces were pierced by machining into hollow pieces. The hollow pieces were heated to 1200° C. in a heating furnace and then subjected to elongation by a cross-type 3-roll rotary mill as shown in FIGS. 3(*a*), 3(*b*), and 3(*c*) to obtain hollow rods. In testing the conventional method, square billets were centrally pierced by drilling into hollow pieces. Each hollow piece was rolled by a bar mill having oval-round type caliber rolls arranged in alternate horizontal vertical pattern, with a mandrel of manganese steel inserted into the hollow piece. A hollow rod was thus obtained.

Figure 6:
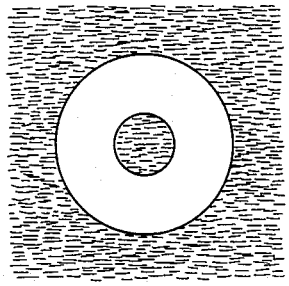
FIG. 6(*a*) is a section showing a hollow rod produced according to the method of the invention.
Figure 6:
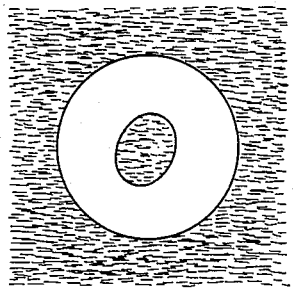

The hollow pieces each was measured at 110 mm in outside diameter and 30 mm in inside diameter. With an outside diameter of 33 mm set as target value, the hollow pieces were subjected to elongation, and the elongated hollow pieces were measured as to their outside and inside diameters, roundness, and wall eccentricity. The results are as shown in Table 1. A section of a hollow rod produced according to the present invention is shown in FIG. 6(*a*). A section of a hollow rod obtained according to the conventional method is shown in FIG. 6(*b*).

TABLE 1

| | Present method (%) | Conventional method (%) |
|---|---|---|
| $\frac{\text{Max outer dia} - \text{Min outer dia}}{\text{Mean outer dia}} \times 100$ | 0.01 | 0.75 |
| $\frac{\text{Max inner dia} - \text{Min inner dia}}{\text{Mean inner dia}} \times 100$ | 0.08 | 18.0 |
| $\frac{\text{Max wall thickness} - \text{Min wall thickness}}{\text{Mean wall thickness}} \times 100$ | 0.07 | 15.0 |

As is clear from Table 1 and FIGS. 6(*a*) and 6(*b*), the present method permits significant improvement in both outside diameter and wall thickness over the conventional method.

As already described, the present method is such that hollow piece is elongated by means of a rotary mill having three or four cone-type rolls adjusted as to cross and feed angles according to the target value, so that the hollow piece is reduced in both outside diameter and wall thickness without using any internal sizing tool. Therefore, variations in outside diameter and wall thickness can be minimized and dimensional accuracy of the product can be remarkably improved. The present method is also economically advantageous because no internal sizing tool is used. Furthermore, it is possible to control the inside diameter over a wide range by suitably selecting cross and feed angles. The equipment required is inexpensive.

Hollow rods may require not only dimensional accuracy, but also mechanical strength. In such case, it is necessary to select cross angle $\gamma$ and feed angle $\beta$ within the following range in connection with the above described elongating operation:

$$\gamma \geqq 0°$$

$$3° \leqq \beta \leqq 20°$$

Since cross angle $\gamma$ is positive, the larger diameter side of each cone-type roll should be positioned on the outlet side of the product as illustrated in FIGS. 3(*a*), 3(*b*), and 3(*c*). This point will now be described with reference to some examples.

Figure 7:
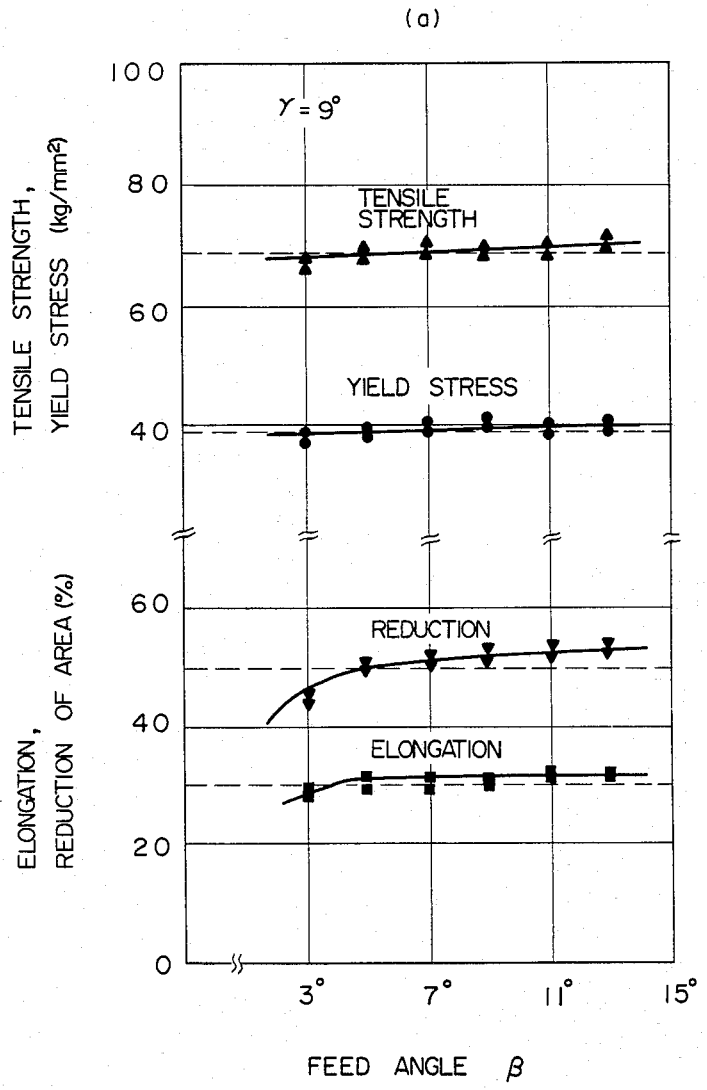
FIG. 7 is a graphical representation showing the relations between cross and feed angles and mechanical properties of hollow rods.
Figure 7:
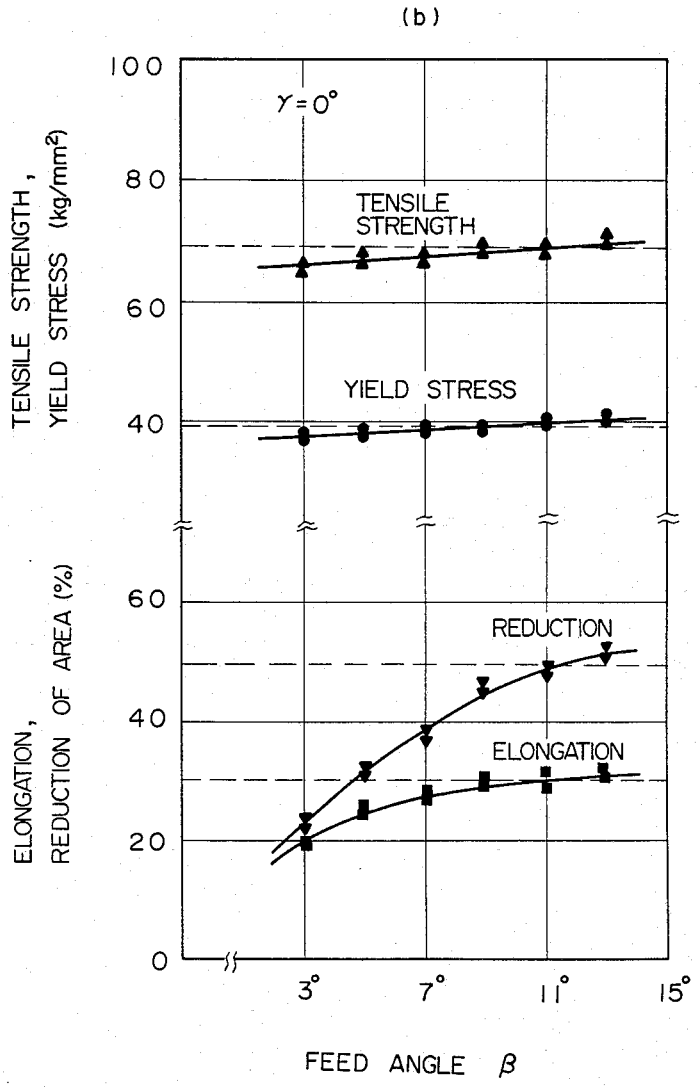
Figure 7:
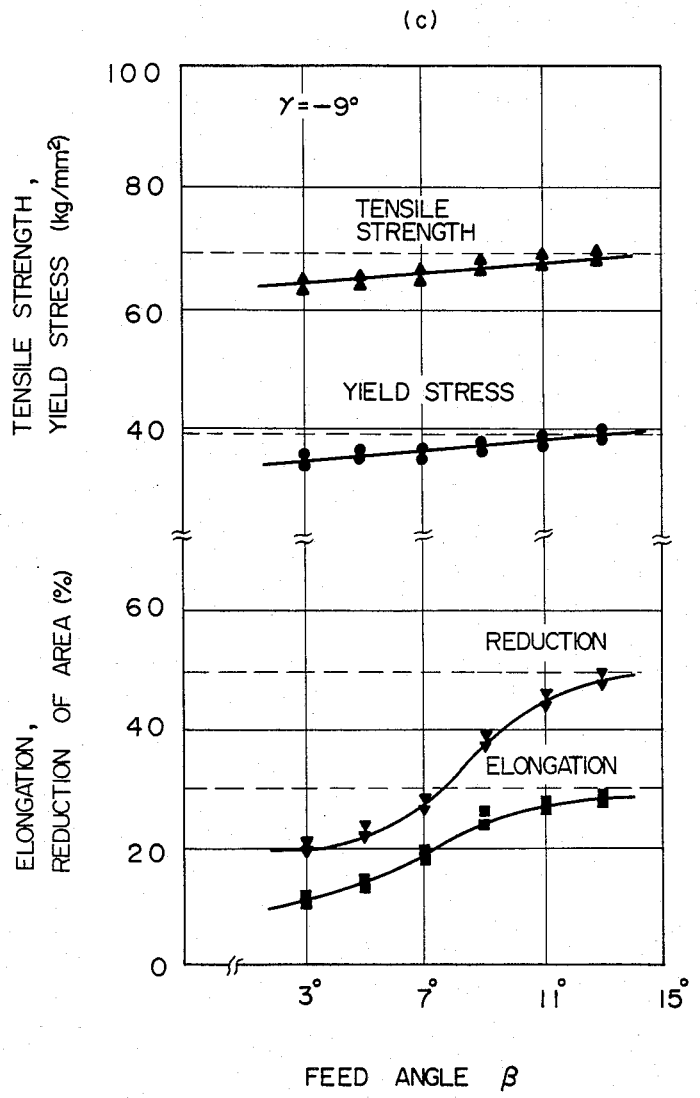
Figure 8:
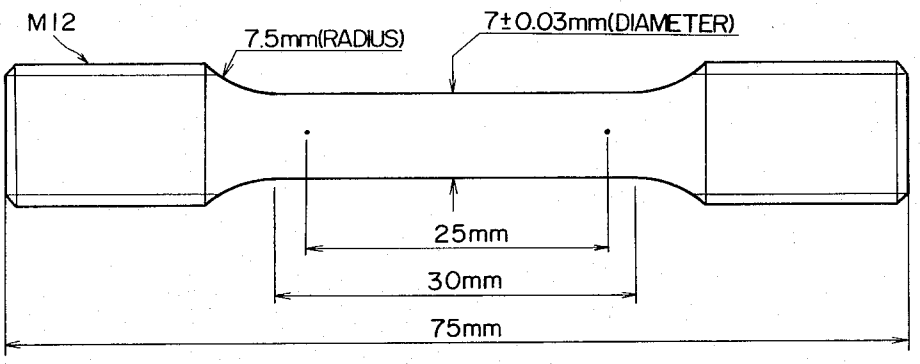
FIG. 8 is a contour of a tension test specimen of hollow rod produced according to the method of the invention.

Graphs in FIGS. 7(*a*), 7(*b*), and 7(*c*) show measurements on mechanical properties of test specimens after elongation. Two kinds of hollow pieces having hole diameters of 8 mm and 10 mm were elongated by a rotary mill having such roll arrangement as shown in FIGS. 3(*a*), 3(*b*), and 3(*c*), with cross angle $\gamma$ and feed angle $\beta$ varied in different ways, the hollow pieces being reduced from 70 mm to 33 mm in outside diameter. The elongated pieces were subjected to heat treatment through which they were kept at 870° C. for one hour, and then they were cooled by air. From the so elongated and heat treated pieces were made test pieces as shown in FIG. 8. The test pieces each had a total length of 75 mm and a machining finished central portion with a diameter of 7±0.03 mm and a length of 30 mm. The test piece extended from the central portion to both ends of M12 (a metric screw, 12 mm dia) at a curvature radius of 7.5 mm. For elongation measurement a 25 mm distance was set between the marks in the center of the test specimen. Post-elongation mechanical properties (tensile strength, yield strength, reduction of area, and elongation) were measured. In the graphs, the abscissa represents feed angle $\beta$ and the ordinate represents mechanical properties. Cross angle $\gamma$ is set at 9° in FIG. 7(*a*), at 0° in FIG. 7(*b*), and at −9° in FIG. 7(*c*). Six feed angles $\beta$ were selected, namely, 3°, 5°, 7°, 9°, 11°, and 13°. In the graphs, broken lines represent mechanical properties prior to elongation, and continuous lines represent post-elongation mechanical properties.

As is clear from the graphs, the greater the cross angle $\gamma$, and the greater the feed angle $\beta$, the greater in the improvement in mechanical properties. Where the cross angle $\gamma$ is −9°, there is seen no improvement in mechanical properties over the level prior to elongation. It is also noted that where the feed angle $\beta$ is lower than 3°, there is a sharp decline particularly in reduction of area and elongation.

From these facts, it is understood that the cross angle $\gamma$ must be $\gamma \geqq 0$ and that the feed angle $\beta$ should be 3° or above and the greater the better. However, it must be noted that where the feed angle $\beta$ is greater than 20°, it is necessary to increase the strength of the housing to an exceptional degree.

As such, the upper limit of feed angle $\beta$ should be 20°.

If the conditions of the above said $\gamma$ and $\beta$ are met, the present method permits achievement of both improved dimensional accuracy and higher mechanical strength.

Description herein has been made with respect to the case where a rotary mill having three rolls is employed, but similarly good effect can be obtained where a rotary mill having a larger number of rolls is employed. However, if more than 5 rolls are used, the size of each roll must be smaller from the standpoint of roll arrangement. Use of such multi-roll type may not be very practical because the proportion of mechanism for cross-angle and feed angle adjustment will necessarily become larger. As a matter of practice, therefore, the number of rolls should be limited to three or four.

In the above described examples, the housing in which rolls are mounted is stationary and the piece be be worked is rotated. It is possible, however, to use such type of rotary mill that the housing and rolls are rotated around the piece to be worked and that the work piece is not rotated.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A method for manufacturing hollow rods, comprising:

a piercing step in which a round billet is pierced into a hollow piece by machining or plastic working, and an elongating step in which the hollow piece is reduced in both outside diameter and wall thickness in order to obtain the desired dimensional values so that it is turned into a hollow rod having a wall thickness to diameter ratio of 25% or above, said elongating step being carried out by means of a rotary mill having three or four cone-type rolls arranged around a pass line for the hollow piece being worked and without any internal sizing tool, said rolls being such that their diameters may be varied straightly along the axes thereof, said rotary mill being of such cross-roll type that the axes of the rolls are inclined or inclinable by a cross angle $\gamma$ so that the shaft ends on either side of the rolls stay close to or stay away from the pass line, the axes of the rolls being inclined by a feed angle $\beta$ so that the shaft ends on the respective sides of the rolls face in the peripheral direction on the one and same side of the hollow piece being worked.

2. A method of manufacturing hollow rods as set forth in claim 1, wherein elongating operation is carried out in such a way that said cross angle $\gamma$ and feed angle $\beta$ are $$\gamma \geqq 0°$$

$$3° \leqq \beta \leqq 20°$$

3. A method of manufacturing hollow rods as set forth in claim 2, wherein the work piece outlet side of each of said rolls is the larger diameter side.

4. A method of manufacturing hollow rods as set forth in claim 1, wherein said cross angle $\gamma$ is $\gamma < 0$ and wherein the work piece outlet side of each of said rolls is the smaller diameter side.

5. A method of manufacturing hollow rods as set forth in claim 1, wherein the work piece is rotated in the elongating step.

6. A method of manufacturing hollow rods as set forth in claim 2, wherein the work piece is rotated in the elongating step.

7. A method of manufacturing hollow rods as set forth in claim 3, wherein the work piece is rotated in the elongating step.

8. A method of manufacturing hollow rods as set forth in claim 4, wherein the work piece is rotated in the elongating step.

9. A method of manufacturing hollow rods as set forth in claim 1, wherein cone-type rolls are rotated around non-rotating work piece in the elongating step.

10. A method of manufacturing hollow rods as set forth in claim 2, wherein cone-type rolls are rotated around non-rotating work piece in the elongating step.

11. A method of manufacturing hollow rods as set forth in claim 3, wherein cone-type rolls are rotated around non-rotating work piece in the elongating step.

12. A method of manufacturing hollow rods as set forth in claim 4, wherein cone-type rolls are rotated around non-rotating work piece in the elongating step.

* * * * *